US010410610B1

(12) United States Patent
Terai

(10) Patent No.: US 10,410,610 B1
(45) Date of Patent: Sep. 10, 2019

(54) DAMPER FOR PIANO

(71) Applicant: KABUSHIKI KAISHA KAWAI GAKKI SEISAKUSHO, Hamamatsu-shi, Shizuoka-ken (JP)

(72) Inventor: Yasushi Terai, Hamamatsu (JP)

(73) Assignee: KABUSHIKI KAISHA KAWAI GAKKI SEISAKUSHO, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 16/289,337

(22) Filed: Feb. 28, 2019

(30) Foreign Application Priority Data

Mar. 5, 2018 (JP) ..... 2018-038639

(51) Int. Cl.
*G10C 3/166* (2019.01)

(52) U.S. Cl.
CPC ..... *G10C 3/166* (2013.01)

(58) Field of Classification Search
CPC ..... G10C 3/166
See application file for complete search history.

(56) References Cited

U.S. PATENT DOCUMENTS 5,528,969 A * 6/1996 Kihara ..... G10C 5/10 84/216
5,600,077 A * 2/1997 Honda ..... G10C 5/10 84/216

FOREIGN PATENT DOCUMENTS

JP 2001-312272 A 11/2001

* cited by examiner

*Primary Examiner* — Kimberly R Lockett
(74) *Attorney, Agent, or Firm* — Lewis Roca Rothgerber Christie LLP

(57) ABSTRACT

A damper for a piano, which has a bifurcated damper felt of which a space between two protrusions is difficult to be narrowed. A damper head extends along three strings in a lengthwise direction thereof and is movable in directions in which the damper moves into and out of contact with the three strings. Damper felt is attached to a string-side surface of the damper head such that it extends in a lengthwise direction of the damper head, and includes two protrusions formed to protrude toward the strings in a bifurcated manner such that they can be brought into contact with the three strings in a state inserted into respective spaces therebetween. The damper felt is attached to the damper head such that deformation of the damper felt in which a space between the two protrusions is narrowed is resisted.

5 Claims, 5 Drawing Sheets

DAMPER FOR PIANO

CROSS-REFERENCE TO RELATED APPLICATION(S)

This application claims priority to Japanese Patent Application Number 03863912018, filed on Mar. 5, 2018, the entire contents of which are incorporated herein by reference.

BACKGROUND OF THE INVENTION

Field of the Invention

The present invention relates to a damper for a piano, which moves into and out of contact with a string in a manner interlocked with operation of a depressed key, to thereby stop and allow vibration of the string, and more particularly to an attachment structure of damper felt which is attached to a damper head.

Description of the Related Art

Conventionally, as a damper for a grand piano, there has been known one disclosed e.g. in Japanese Laid-Open Patent Publication No. 2001-312272. This damper is comprised of a block-shaped damper head extending in the front-rear direction and two (front and rear) pieces of damper felt attached to the bottom surface of the damper head. The damper head is attached to an upper end of a vertically extending damper wire, and the damper wire is attached to a damper lever extending in the front-rear direction, via a damper wire flange provided at the lower end of the damper wire. The damper lever has a rear end thereof pivotally supported and a front end thereof placed on a rear end of a key extending in the front-rear direction. In a state where the key remains undepressed, i.e. in a key-released state, the damper presses a string associated with the key by its own weight, with the pieces of damper felt held in contact with the string from above.

In the above-mentioned piano, when the key is depressed, the damper lever is pivotally moved upward by the rear end of the key, whereby the damper wire flange and the damper wire are pushed up, moving the damper head upward in unison with the damper felt. As a consequence, the pieces of damper felt move out of contact with the string and then the string is struck by a hammer, whereby the string is vibrated to generate a piano tone. On the other hand, when the key is released, each of the damper lever, the damper wire flange, and the damper wire moves downward, and in accordance with the downward movement, the damper head and the damper felt move downward and return to their respective original positions. As a consequence, the pieces of damper felt hold the string to thereby stop the vibration of the same, so that the sounding of the piano tone is stopped.

In general, an acoustic piano uses strings for respective ones of all pitch ranges from the lowest pitch range to the highest pitch range and dampers suitable for the respective strings. Specifically, in a grand piano, strings are each stretched in a manner horizontally extending in the front-rear direction, and the string is thicker and longer as the pitch is lower. The strings are provided on a key-by-key basis, with a unit of one or two strings for each key in lower pitch ranges and a unit of three strings for each key in middle to higher pitch ranges.

FIGS. 7A and 7B show a conventional damper for middle/high-pitched sound, together with three strings S whose sounding is stopped by the damper. As shown in FIGS. 7A and 7B, the damper 11 is comprised of a damper head 12 and two (front and rear) pieces of damper felt 14 and 14 each bonded to the bottom surface of the damper 11 via an associated pieces of under felt 13. The damper head 12 extends in the front-rear direction and has a mountain shape in side view and a bottom surface 12*a* formed flat. On the other hand, each piece of damper felt 14 extends in the front-rear direction and has a lower half thereof formed into a bifurcated shape in which two protrusions protrude downward toward the strings S such that the protrusions (hereinafter the left and right protrusions appearing in FIG. 7B will be referred to as "the left protrusion 14L" and "the right protrusion 14R", respectively) can be inserted into respective spaces between the three strings S. Further, the damper felt 14 has an upper surface 14*a*, which faces toward the damper head 12, formed flat and bonded to the bottom surface 12*a* of the damper head 12 via the under felt 13 which is in the form of a thin board. Note that in the following description, if it is required to distinguish the three strings S from one another, the strings S will be referred to as "the left string S1", "the middle string S2", and "the right string S3", respectively, in the mentioned order from the left.

In the damper 11 constructed as above, when the damper 11 moves downward during key release after key depression, the left protrusion 14L of the damper felt 14 is inserted from above between the left string S1 and the middle string S2, and the right protrusion 14R is inserted from above between the middle string S2 and the right string S3, whereby vibrations of the respective three strings S are stopped simultaneously.

However, in the damper 11, shape retention of the damper felt 14 is degraded due to aging, which sometimes causes narrowing of the space between the left protrusion 14L and the right protrusion 14R in the bifurcated shape, as shown in FIG. 8, for example. In such a case, in the damper 11 having moved downward, gaps can be formed between the left protrusion 14L of the damper felt 14 and the left string S1 and between the right protrusion 14R of the same and the right string S3, respectively, which disables proper sounding stop operation of the damper 11, which is to be performed by stopping vibrations of all the three strings S1 to S3 simultaneously. Of course, it is possible to adjust and increase the space between the left protrusion 14L and the right protrusion 14R during tuning of the piano. However, the space between the left and right protrusions 14L and 14R can be narrowed again e.g. due to aging or an environment under which the piano is used.

SUMMARY OF THE INVENTION

It is an object of the present invention to provide a damper for a piano, which includes damper felt having a bifurcated shape in association with three strings and makes a space between two protrusions of the damper felt difficult to be narrowed, to thereby enable stable proper sounding stop operation to be performed over a long term.

To attain the above object, the present invention provides a damper for a piano, which moves into and out of contact with three strings extending in parallel with a space therebetween and configured in association with a single key, in a manner interlocked with depression of the key, to thereby stop and allow vibration of the strings, comprising a damper head extending along the three strings in a lengthwise direction of the strings and configured to be movable in directions in which the damper moves into and out of contact with the three strings, and damper felt attached to a side of the damper head, toward the strings, and extending in a lengthwise direction of the damper head, the damper felt having two protrusions which protrude toward the strings in a bifurcated manner and are configured such that the protrusions can be brought into contact with the three strings in a state inserted into respective spaces between the three strings, wherein the damper felt is attached to the damper head such that deformation of the damper felt in which a space between the two protrusions is narrowed is resisted.

With the construction of the damper, the damper felt is attached to the string-side surface of the damper head configured to be movable in directions in which the damper moves into and out of contact with the three strings. The damper felt has the two protrusions which protrude toward the strings in a bifurcated manner and are configured such that the protrusions can be brought into contact with the three strings in a state inserted into respective spaces between the three strings. Further, as described hereinafter, the damper felt is attached to the damper head such that deformation of the damper felt in which the space between the two protrusions is narrowed is resisted. Therefore, the damper of the present invention makes it possible to make the space between the two protrusions of the damper felt difficult to be narrowed, to thereby enable stable proper sounding stop operation to be performed over a long term.

Preferably, an attaching surface of the damper head to which the damper felt is attached has a cross-sectional shape orthogonal to the lengthwise direction of the damper head, which is convex, protruding toward the strings, and the damper felt in a state before attachment to the damper head has a flat attached surface to be attached to the attaching surface.

With the construction of this preferred embodiment, while the cross-sectional shape of the attaching surface of the damper head to which the damper felt is attached is formed convex, protruding toward the strings, the damper felt in a state before attachment to the damper head has the flat attached surface. In a state where the flat attached surface of the damper felt has been attached to the convex attaching surface of the damper head, damper head-side portions of the respective protrusions of the damper felt are in a state pulled toward the damper head. In other words, stress acts on the damper felt in directions opposite to respective directions in which the space between the two protrusions is narrowed. As a consequence, it is possible to suppress narrowing of the space between the two protrusions. Further, the same damper felt as the conventional one can be used, and therefore, it is possible to provide the damper of the present invention while suppressing increase in manufacturing costs by using the existing damper felt.

More preferably, the cross-sectional shape of the attaching surface of the damper head is a V shape, a trapezoidal shape, or an arcuate shape.

With the construction of this preferred embodiment, since the cross-sectional shape of the attaching surface of the damper head is a V shape, a trapezoidal shape, or an arcuate shape, it is possible to easily form the attaching surface of the damper head which is in a convex shape in cross section. Further, when manufacturing the damper head constructed as above, it is possible to obtain a desired type of damper head with ease e.g. by cutting the attaching surface of a damper head having the same flat attaching surface as the conventional one.

Preferably, the damper for a piano further comprises an interposing member to be attached in a state interposed between the damper head and the damper felt, an attaching surface of the interposing member, to which the damper felt is attached, has a cross-sectional shape orthogonal to the lengthwise direction of the damper head, which is convex, protruding toward the strings, and the damper felt in a state before attachment to the damper head has a flat attached surface to be attached to the attaching surface of the interposing member.

With the construction of this preferred embodiment, in the interposing member provided between the damper head and the damper felt, the attaching surface to which the damper felt is attached is formed in a convex shape protruding toward the strings. On the other hand, the damper felt in a state before attachment to the damper head has the flat attached surface. In a state where the flat attached surface of the damper felt is attached to the convex attaching surface of the interposing member, damper head-side portions of the respective protrusions of the damper felt are in a state pulled toward the damper head similar to the preferred embodiment described above. This causes stress to act on the damper felt in directions opposite to respective directions in which the space between the two protrusions is narrowed. As a consequence, it is possible to suppress narrowing of the space between the two protrusions. Further, as a damper head and damper felt, the same types as the conventional ones can be used, and therefore, it is possible to provide the damper of the present invention while suppressing increase in manufacturing costs by using the existing damper head and the existing damper felt.

Preferably, the attaching surface of the damper head, to which the damper felt is attached, is formed flat, the damper felt in a state before attachment to the damper head has an attached surface to be attached to the attaching surface, and the attached surface has a flat portion located in a central part thereof and extending in a lengthwise direction of the dumper head and a pair of left and right sloped portions which are continuous with left and right opposite ends of the flat portion 4*b* and are sloped downward as the sloped portions extend outward.

With the construction of this preferred embodiment, the attached surface of the damper felt is attached to the flat attaching surface of the damper head. The attached surface has the flat portion located in the central part thereof and the pair of left and right sloped portions which are continuous with the respective left and right opposite ends of the flat portion and are sloped downward as they extend from the flat portion. In a state in which the attached surface of the damper felt, or more specifically, the flat portion and the pair of left and right sloped portions of the attached surface are attached to the flat attaching surface of the damper head, damper head-side portions of the respective protrusions of the damper felt are in a state pulled toward the damper head similar to the preferred embodiment described above. This causes stress to act on the damper felt in directions opposite to respective directions in which the space between the two protrusions is narrowed, whereby it is possible to suppress narrowing of the space between the two protrusions. Further, as the damper head, the same type as the conventional one can be used, and therefore, it is possible to provide the damper of the present invention while suppressing increase in manufacturing costs by using the existing damper head.

The above and other objects, features, and advantages of the present invention will become more apparent from the following detailed description taken in conjunction with the accompanying drawings.

BRIEF DESCRIPTION OF THE DRAWINGS

FIGS. 2A to 2C are views showing parts of the damper in a state before assembly, in which FIG. 2A shows a damper head, FIG. 2B shows under felt, and FIG. 2C shows damper felt.

FIGS. 6A and 6B are views useful in explaining a damper for a piano, according to a second embodiment of the present invention, in which FIG. 6A shows the damper in a state before assembly, and FIG. 6B shows the damper in a state after assembly.

DETAILED DESCRIPTION OF PREFERRED EMBODIMENTS

Figure 1A:
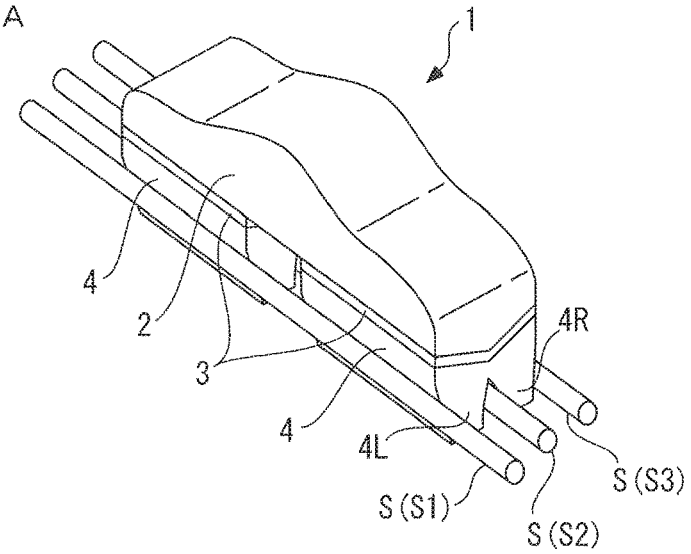
FIG. 1A is a perspective view of a damper for a piano, according to a first embodiment of the present invention, together with three strings whose sounding is stopped by the damper.
Figure 1B:
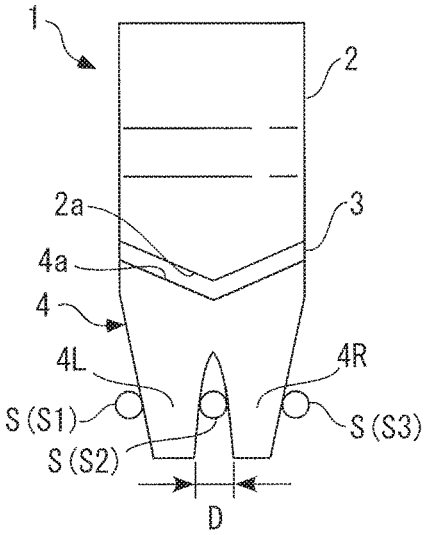
FIG. 1B is a front view of the damper shown in FIG. 1A.

The present invention will now be described in detail with reference to the drawings showing preferred embodiments thereof. FIGS. 1A and 1B show a damper for a grand piano, according to a first embodiment of the present invention, together with three strings whose sounding is stopped by the damper. The damper 1 shown in FIGS. 1A and 1B is associated with a set of middle/high-pitched sound strings S, i.e. three strings S (a left string S1, a middle string S2, and a right strings S3), and has the same construction as that of the damper 11 described hereinabove. More specifically, the damper 1 is comprised of a damper head 2 and two (front and rear) pieces of damper felt 4 and 4 attached to the bottom surface of the damper head 2 via respective pieces of under felt 3. Note that the three strings S1, S2, and S3 are stretched such that they each extend horizontally in the front-rear direction side by side with a predetermined space therebetween in the left-right direction.

The damper head 2 is made e.g. of wood or a synthetic resin and is formed into a block shape extending in the front-rear direction over a predetermined length (e.g. 40 mm) and having a mountain shape in side view and a predetermined lateral width (e.g. 10.5 mm). The damper head 2A has a bottom surface 2*a* (attaching surface) of the damper head 2 formed into a convex shape, more specifically, a V shape protruding downward, in cross section orthogonal to the lengthwise direction of the damper head 2, over the entire longitudinal length thereof. Bonded to the bottom surface 2*a* of the damper head 2 are two (front and rear) pieces of under felt 3 and 3 each made e.g. of red felt and formed with a predetermined thickness (e.g. 1 mm) into a V shape in cross section along the bottom surface 2*a*. The pieces of damper felt 4 and 4 are bonded to the lower surfaces of the respective pieces of under felt 3 and 3.

Each piece of damper felt 4 extends along the damper head 2 in the lengthwise direction thereof and has a predetermined length which is smaller than half of the length of the damper head 2. Further, the damper felt 4 protrudes downward toward the strings S in a bifurcated shape to form two protrusions (a left protrusion 4L and a right protrusion 4R) such that the protrusions can be brought into contact with the strings S in a state inserted into respective spaces between the three strings S.

As shown in FIG. 1B, each of the left protrusion 4L and the right protrusion 4R of the damper felt 4 is formed to have a lateral width progressively reduced downward, and the width of a lower end thereof is set to be smaller than the distance between adjacent two of the strings S. Further, a distance D between the lower ends of the respective left and right protrusions 4L and 4R is set to be larger than the diameter of the string S. Furthermore, an upper surface 4*a* (attached surface) of the damper felt 4 is formed along the shape of the bottom surface 2*a* of the damper head 2 and that of the under felt 3 into a V shape in front view. Specifically, in the upper surface 4*a* of the damper felt 4, portions located immediately upward of the respective left and right protrusions 4L and 4R slope upward as they extend outward (leftward and rightward, respectively, as viewed in FIG. 1B).

Figure 2A:
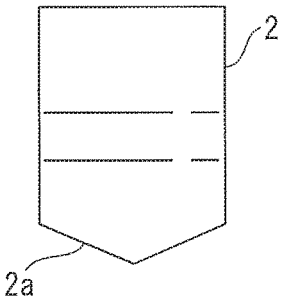
Figure 2B:
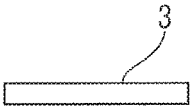
Figure 2C:
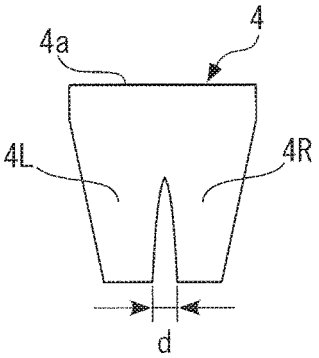

Now, a description will be given, with reference to FIGS. 2A to 2C and 3A to 3C, of a procedure for manufacturing the damper 1. First, the damper head 2, the under felt 3, and the damper felt 4 are prepared, as shown in FIGS. 2A, 2B, and 2C. In this case, the damper head 2 is formed such that the entire bottom surface 2*a* in the lengthwise direction (i.e. in the direction toward the far side in FIG. 2A) has the V shape in cross section. As for the under felt 3, two pieces each having the same length as the damper felt 4 are prepared by cutting felt formed in an elongated shape, as required. Further, as for the damper felt 4, two pieces are prepared each of which has the same construction as the conventional damper felt 4, i.e. each of which protrudes downward in a bifurcated shape and has an upper surface 4*a* formed flat. Note that in this damper felt 4, a distance d between the lower ends of the respective left and right protrusion 4L and 4R is set to be smaller than the distance D set when the damper felt 4 is attached to the damper head 2.

Figure 3A:
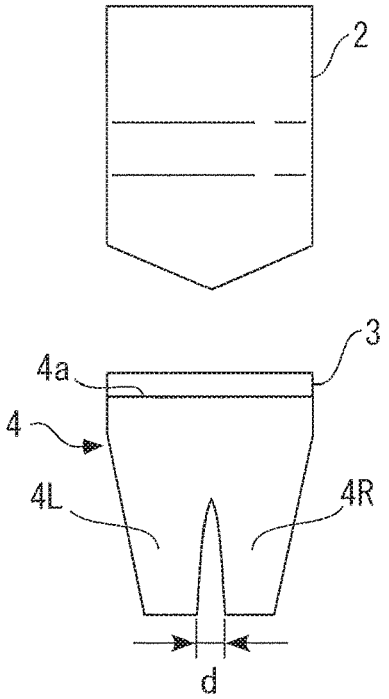
FIGS. 3A to 3C are views useful in explaining a procedure for assembling the damper.
Figure 3B:
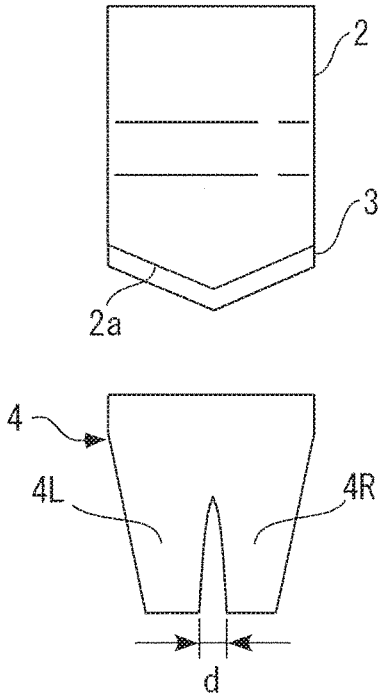
Figure 3C:
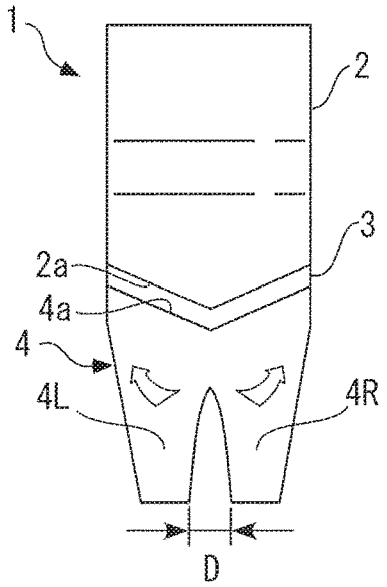

Next, as shown in FIGS. 3A and 3B, the under felt 3 is bonded to the entire upper surface 4*a* of the damper felt 4 (FIG. 3A) or to a predetermined position of the bottom surface 2*a* of the damper head 2 (FIG. 3B). Then, the upper surface 4*a* of the damper felt 4 is bonded to the bottom surface 2*a* of the damper head 2 via the under felt 3, as shown in FIG. 3C. In this case, in the damper felt 4, the portions located immediately upward of the respective left and right protrusions 4L and 4R are pulled upward toward the damper head 2. This caused stress indicated by hollow arrows in FIG. 3C to act on the damper felt 4. As a consequence, it is possible to suppress narrowing of the space between the left and right protrusions 4L and 4R of the damper felt 4.

As described above, according to the present embodiment, while the bottom surface 2*a* of the damper head 2 is formed in the V shape protruding downward, the damper felt 4 is formed to have a flat upper surface 4*a* in a state before attachment to the damper head 2 and is attached to the damper head 2, with the upper surface 4*a* deformed into the V shape along the shape of the bottom surface 2*a* of the damper head 2. In other words, the damper felt 4 is attached to the damper head 2 such that deformation of the damper felt 4 in which the space between the left and right protrusions 4L and 4R is narrowed is resisted. This makes it possible to make the space between the left and right protrusions 4L and 4R of the damper felt 4 difficult to be narrowed, to thereby enable the damper 1 to stably perform proper sounding stop operation over a long term.

Figure 4A:
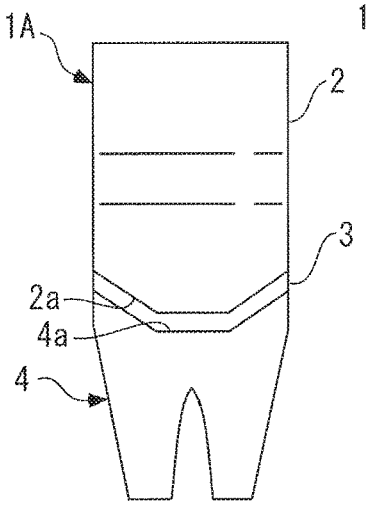
FIGS. 4A to 4C are views showing variations of the damper according to the first embodiment of the present embodiment.
Figure 4B:
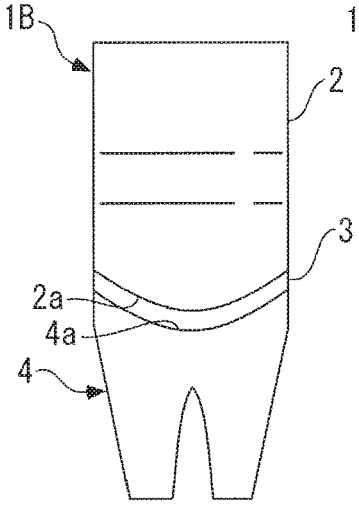
Figure 4C:
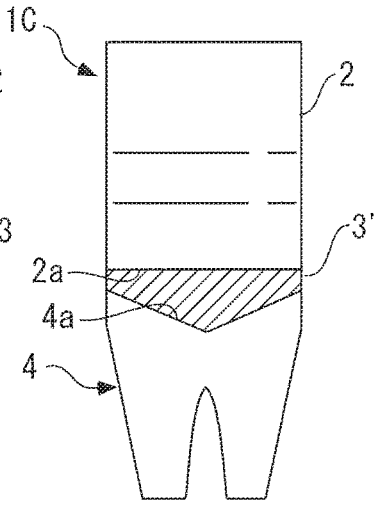

FIGS. 4A to 4C show variations of the above-described damper 1, or specifically, dampers adopting respective damper heads 2 having respective different types of bottom surfaces 2*a* each formed in a convex shape protruding downward. In a damper 1A according to a first variation shown in FIG. 4A, the bottom surface 2*a* of the damper head 2 is formed in a trapezoidal shape, and in a damper 1B according to a second variation shown in FIG. 4B, the bottom surface 2*a* of the damper head 2 is formed in an arcuate shape. Therefore, in each of the dampers 1A and 1B, the under felt 3 and the upper surface 4*a* of the damper felt 4 are attached to the bottom surface 2*a* of the damper head 2 along the shape of the bottom surface 2*a* of the damper head 2.

Further, in a damper 1C according to a third variation shown in FIG. 3C, the bottom surface 2*a* of the damper head 2 is formed flat as in the conventional damper head, and an interposing member 3' in a convex shape protruding downward is provided between the damper head 2 and the damper felt 4. The interposing member 3' is made of the same felt as the under felt 3 of the damper 1 described hereinabove, or of a synthetic resin or the like, and has an upper surface formed flat and a bottom surface formed in a V shape in cross section.

Similar to the damper 1, described hereinabove, each of the above-described dampers 1A, 1B, and 1C makes it possible to make the space between the left and right protrusions 4L and 4R of the damper felt 4 difficult to be narrowed, to thereby enable stable proper sounding stop operation to be performed over a long term.

Figure 5A:
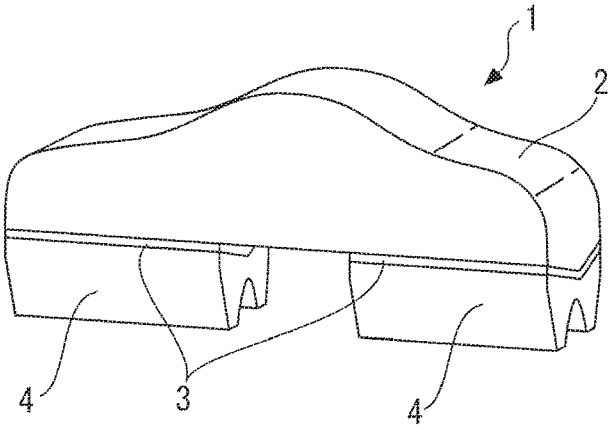
FIG. 5A is a perspective view of the damper for a piano, according to the first embodiment of the present invention.
Figure 5B:
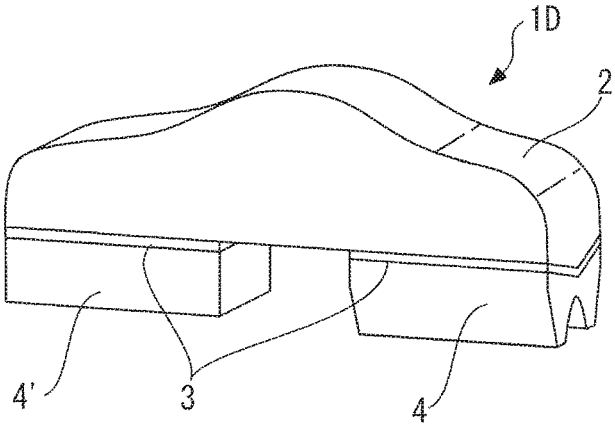
FIG. 5B is a perspective view of a damper according to a variation.

Although in the first embodiment, the damper 1 is provided with the two pieces of damper felt 4 and 4 each formed in a bifurcated shape as shown in FIG. 5A, the present invention is not limited to this, but for example, as illustrated by a damper 1D according to a fourth variation shown in FIG. 5B, a damper may be provided with two (front and rear) pieces of damper felt such that only one damper felt 4 is formed in a bifurcated shape, and the other damper felt 4' has a bottom surface formed flat. In this damper 1D, only a portion, where the damper felt 4 having a bifurcated shape is attached, of the bottom surface 2*a* of the damper head 2 is formed in the convex shape protruding downward as described hereinabove.

Figure 6A:
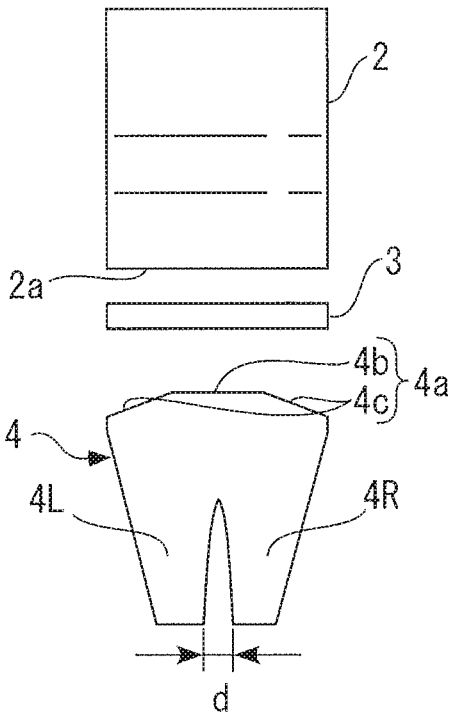
Figure 6B:
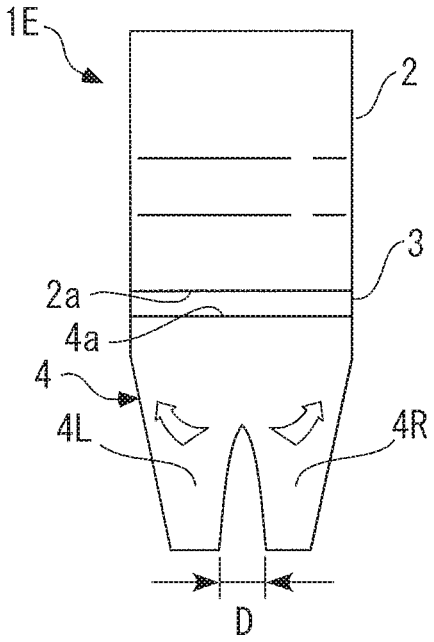
Figure 7A:
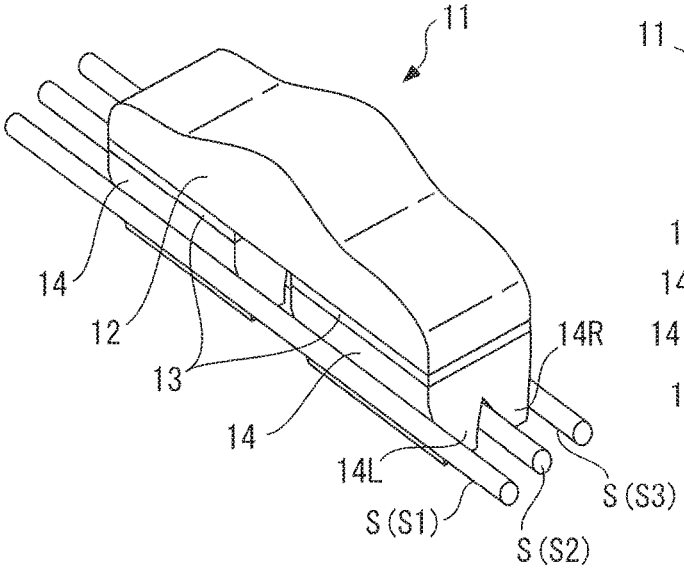
FIG. 7A is a perspective view of a conventional damper for a piano, together with three strings whose sounding is stopped by the damper.
Figure 7B:
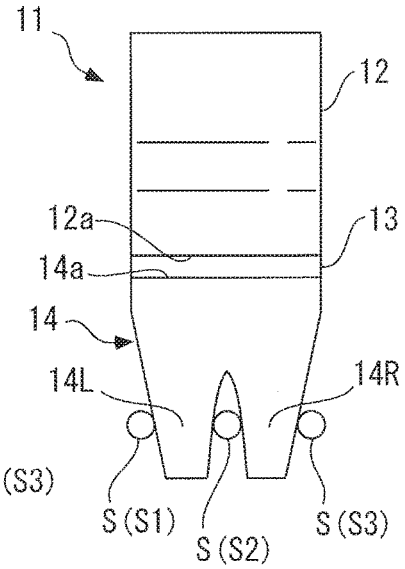
FIG. 7B is a front view of the damper shown in FIG. 7A.
Figure 8:
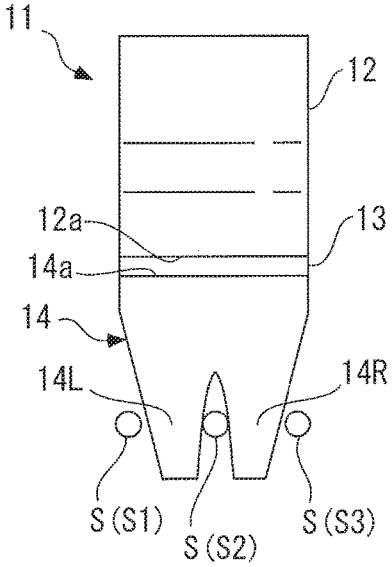
FIG. 8 is a view showing the conventional damper for a piano, together with the three strings whose sounding is stopped by the damper, in a state in which sounding of two strings on opposite sides cannot be stopped due to aging of damper felt.

FIGS. 6A and 6B show a damper according to a second embodiment of the present invention. FIG. 6A shows the damper in a state before assembly, and FIG. 6B shows the damper in a state after assembly. As shown in FIG. 6A, this damper 1E is distinguished from the damper 1 of the first embodiment by the shape of the bottom surface 2*a* of the damper head 2 and that of the upper surface 4*a* of the damper felt 4.

More specifically, in the damper 1E, the bottom surface 2*a* of the damper head 2 is formed flat. On the other hand, the upper surface 4*a* of the damper felt 4 is comprised of a flat portion 4*b* formed flat and a pair of left and right sloped portions 4*c* and 4*c* which are continuous with respective left and right opposite ends of the flat portion 4*b* and are sloped downward as they extend outward (leftward and rightward, as viewed in FIG. 6A) from the flat portion 4*b*. The flat portion 4*b* is located in a central part of the upper surface 4*a* of the damper felt 4 and extends along the damper head 2 in the lengthwise direction thereof. The pair of left and right sloped portions 4*c* and 4*c* each extend along the damper head 2 in the lengthwise direction thereof similar to the flat portion 4*b* and are located immediately upward of the respective left and right protrusions 4L and 4R.

In a state where the upper surface 4*a* of the damper felt 4 is attached to the bottom surface 2*a* of the damper head 2 via the under felt 3, the flat portion 4*b* and the two sloped portions 4*c* and 4*c* are flush with each other as shown in FIG. 6B. In this case, as in the first embodiment described hereinabove, stress indicated by hollow arrows in FIG. 6B acts on the damper felt 4. As a consequence, it is possible to suppress narrowing of the space between the left and right protrusions 4L and 4R of the damper felt 4. Therefore, the damper 1E of the present embodiment can provide the same advantageous effect as provided by the damper 1 of the first embodiment.

Note that the present invention is not limited to the above-described embodiments, but it can be practiced in various forms. For example, although in each of the embodiments, the damper for a grand piano is described, it is to be understood that the present invention is also applicable to a damper for an upright piano. Further, in the damper 1 of the first embodiment, the same damper felt as the conventional one having a flat upper surface can be used as the damper felt 4, and in the damper 1E of the second embodiment, the same damper head as the conventional one having a flat bottom surface can be used as the damper head 2. This makes it possible to provide a damper of the present invention while suppressing increase in manufacturing costs by using the existing damper felt or the existing damper head. Furthermore, the construction of details of each of the damper 1, the damper head 2, the under felt 3, and the damper felt 4 in the embodiments is described only by way of example, and it can be modified, as desired, within the scope of the subject matter of the present invention.

What is claimed is:

1. A damper for a piano, which moves into and out of contact with three strings extending in parallel with a space therebetween and configured in association with a single key, in a manner interlocked with depression of the key, to thereby stop and allow vibration of the strings, comprising:

a damper head extending along the three strings in a lengthwise direction of the strings and configured to be movable in directions in which the damper moves into and out of contact with the three strings; and damper felt attached to a side of the damper head, toward the strings, and extending in a lengthwise direction of the damper head, the damper felt having two protrusions which protrude toward the strings in a bifurcated manner and are configured such that the protrusions can be brought into contact with the three strings in a state inserted into respective spaces between the three strings, wherein the damper felt is attached to the damper head such that deformation of the damper felt in which a space between the two protrusions is narrowed is resisted.

2. The damper for a piano, according to claim 1, wherein an attaching surface of the damper head to which the damper felt is attached has a cross-sectional shape orthogonal to the lengthwise direction of the damper head, which is convex, protruding toward the strings, and wherein the damper felt in a state before attachment to the damper head has a flat attached surface to be attached to the attaching surface.

3. The damper for a piano, according to claim 2, wherein the cross-sectional shape of the attaching surface of the damper head is a V shape, a trapezoidal shape, or an arcuate shape.

4. The damper for a piano, according to claim 1, further comprising an interposing member to be attached in a state interposed between the damper head and the damper felt, and wherein an attaching surface of the interposing member, to which the damper felt is attached, has a cross-sectional shape orthogonal to the lengthwise direction of the damper head, which is convex, protruding toward the strings, and wherein the damper felt in a state before attachment to the damper head has a flat attached surface to be attached to the attaching surface of the interposing member.

5. The damper for a piano, according to claim 1, wherein the attaching surface of the damper head, to which the damper felt is attached, is formed flat, wherein the damper felt in a state before attachment to the damper head has an attached surface to be attached to the attaching surface, and wherein the attached surface has a flat portion located in a central part thereof and extending in a lengthwise direction of the dumper head and a pair of left and right sloped portions which are continuous with left and right opposite ends of the flat portion 4*b* and are sloped downward as the sloped portions extend outward.

* * * * *